US012181176B2

(12) United States Patent
Lu et al.

(10) Patent No.: US 12,181,176 B2
(45) Date of Patent: Dec. 31, 2024

(54) INDOOR UNIT OF AIR CONDITIONER, AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Gen Lu, Guangdong (CN); Shuyang Pi, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 551 days.

(21) Appl. No.: 17/409,898

(22) Filed: Aug. 24, 2021

(65) Prior Publication Data

US 2021/0404701 A1 Dec. 30, 2021

Related U.S. Application Data

(63) Continuation of application No. PCT/CN2019/112442, filed on Oct. 22, 2019.

(30) Foreign Application Priority Data

Mar. 3, 2019 (CN) ..... 201910158195.5
Mar. 3, 2019 (CN) ..... 201920268071.8

(51) Int. Cl.
*F24F 13/22* (2006.01)
*F24F 8/90* (2021.01)
*F24F 13/20* (2006.01)

(52) U.S. Cl.
CPC ..... *F24F 13/222* (2013.01); *F24F 8/90* (2021.01); *F24F 13/20* (2013.01)

(58) Field of Classification Search
CPC ..... F24F 13/22; F24F 13/222; F24F 13/224; F24F 2013/227; F24F 8/90; F24F 13/20;
(Continued)

(56) References Cited

U.S. PATENT DOCUMENTS 9,134,067 B2 * 9/2015 Ahn ..... D06F 58/24

FOREIGN PATENT DOCUMENTS

CN 101758041 A 6/2010
CN 106642328 A 5/2017
(Continued)

OTHER PUBLICATIONS

International Search Report and Written Opinion dated Jan. 19, 2020 received in International Application No. PCT/CN2019/112442 together with an English language translation.
(Continued)

*Primary Examiner* — Tavia Sullens
*Assistant Examiner* — Esmeralda Arreguin-Martinez
(74) *Attorney, Agent, or Firm* — Scully, Scott, Murphy & Presser, P.C.

(57) ABSTRACT

Disclosed are an indoor unit and an air conditioner. The indoor unit has a chassis, a washing module, and a water blocking structure. The chassis has a condensate area and an effluent area adjacent to the condensate area and positioned above the condensate area. A portion of a bottom of the effluent area adjacent to the condensate area is recessed with a water outlet hole in communication with the condensate area. The washing module is mounted on the chassis and has a discharge pipe extending into the effluent area. The water blocking structure is arranged between the condensate area and the effluent area. A top end of the water blocking structure is connected to the washing module, and a lower end of the water blocking structure is in front of the water outlet hole to shield a part of the water outlet hole.

14 Claims, 9 Drawing Sheets

(58) Field of Classification Search
CPC .. F24F 2221/225; F24F 2221/22; F24F 1/035; F24F 13/28; F28G 1/16; F28G 1/166; F28G 9/00; D06F 58/45; D06F 58/206; D06F 58/22; D06F 58/24; F25D 21/14; B60H 1/3233; B01D 46/79
See application file for complete search history.

(56) References Cited

FOREIGN PATENT DOCUMENTS

| | | | |
|---|---|---|---|
| CN | 106765924 | A | 5/2017 |
| CN | 106767124 | A | 5/2017 |
| CN | 106767125 | A | 5/2017 |
| CN | 107435997 | A | 12/2017 |
| CN | 108731204 | A | 11/2018 |
| CN | 108895573 | A | 11/2018 |
| CN | 208566876 | U | 3/2019 |
| CN | 110017534 | A | 7/2019 |
| CN | 209672460 | U | 11/2019 |
| EP | 3 267 124 | A1 | 1/2018 |
| JP | 2003021495 | A | 1/2003 |
| JP | 2005036996 | A | 2/2005 |
| JP | 2012163297 | A | 8/2012 |
| JP | 2017116235 | A | 6/2017 |
| KR | 20100120542 | A | 11/2010 |
| KR | 10-2018-0098480 | A | 9/2018 |
| WO | 2008/035847 | A2 | 3/2008 |

OTHER PUBLICATIONS

Supplementary European Search Report dated Sep. 25, 2020 received in European Patent Application No. EP 19798159.0.
Decision to Grant Patent dated Jun. 15, 2023 received in Japanese Patent Application No. JP 2019-563831.
First Office Action dated Oct. 28, 2023 received in Chinese Patent Application No. CN 201910158195.5.

* cited by examiner

INDOOR UNIT OF AIR CONDITIONER, AND AIR CONDITIONER

CROSS REFERENCE TO RELATED APPLICATIONS

The present application is a continuation application of PCT International Application No. PCT/CN2019/112442, filed on Oct. 22, 2019, which claims the priority of Chinese Patent Application with No. 201920268071.8, entitled "INDOOR UNIT OF AIR CONDITIONER AND AIR CONDITIONER", filed on Mar. 3, 2019, and claims the priority of Chinese Patent Application with No. 201910158195.5, entitled "INDOOR UNIT OF AIR CONDITIONER, AND AIR CONDITIONER", filed on Mar. 3, 2019, the entirety of which are hereby incorporated herein by reference. No new matter has been introduced.

FIELD

The present disclosure relates to the technical field of air conditioners, and more particularly to an indoor unit of an air conditioner and an air conditioner.

BACKGROUND

The statement here provides only background information related to the present disclosure and does not necessarily constitute the prior art. With increasing demands of users on quality of life, users give increasing emphases on health problems caused by uses of air conditioners. For example, the air conditioner with a fresh air device, which can introduce outside fresh air into air-conditioned room, has been on the market. In addition, it is hard to clean the filter screen in the use process of the air conditioner, which brings a serious impact on health. Focusing on this problem, there exists, in the art, a kind of air conditioner equipped with a washing module for cleaning the filter screen automatically. In detail, the washing module is configured to adopt the condensate water generated during the operation process of the air conditioner to wash the filter screen, and the generated effluent flows into a discharge pipe and is guided to an effluent area below the discharged pipe, finally the effluent is drained out through a drain pipe communicated with the effluent area. However, as the condensate area containing condensate water is also communicated with the drain pipe, and the condensate area is normally arranged near to the effluent area, the effluent from the effluent area is prone to flow into the condensate area, resulting in a contamination of condensed water, and further reducing the clean effect of the filter screen.

SUMMARY

The present disclosure provides an indoor unit of an air conditioner, aiming at preventing effluent discharged from a washing module from flowing into a condensate area.

In order to achieve the above objective, the indoor unit provided by the present disclosure includes: a chassis, a washing module, and a water blocking structure. The chassis includes a condensate area and an effluent area adjacent to the condensate area and above the condensate area. A portion of a bottom of the effluent area adjacent to the condensate area defines a water outlet hole. The washing module is mounted on the chassis and has a discharge pipe extending into the effluent area. The water blocking structure is arranged between the condensate area and the effluent area.

In one embodiment, the bottom of the effluent area is inclined downwards to the condensate area.

In one embodiment, the indoor unit further includes an outlet pipe communicated with the water outlet hole. The bottom of the effluent area defines an avoiding groove, a side of the avoiding groove facing the condensate area defines a notch communicated with the condensate area, and a side of the avoiding groove opposite to the condensate area defines the water outlet hole. The water blocking structure is extended into the avoiding groove, a top end of the water blocking structure is connected to the washing module, and a lower end of the water blocking structure is in front of the water outlet hole to shield a part of the water outlet hole.

In one embodiment, a lower edge of the water blocking structure is positioned lower than a portion of the bottom of the effluent area extended downwards to the water blocking structure and contacted with the water blocking structure.

In one embodiment, the washing module further includes: a water box; and a water pump mounted to a lower end of the water box. The water pump includes: a protruding edge protruded outwards from an upper edge of the water pump and detachably connected to a lower end of the water box, and the water blocking structure is arranged on the protruding edge.

In one embodiment, the water blocking structure comprises: a water baffle extended downwards from the protruding edge; and a support board extended forwards and upwards from a lower edge of the water baffle and connected to the protruding edge.

In one embodiment, the water blocking structure is integrally arranged with the water pump.

In one embodiment, the indoor unit further includes a water blocking flange protruded forwards and upwards from a lower edge of the effluent area.

In one embodiment, the water blocking flange is abutted against the water blocking structure.

In one embodiment, discharge pipe comprises a discharge end facing the effluent area, with an opening of the discharge end flared downwards.

In one embodiment, a lower end surface of the discharge end is inclined downwards to the condensate area, and a gap is defined between the lower end surface of the discharge end and the bottom of the effluent area.

In one embodiment, an inclination angle of the lower end surface of the discharge end is consistent with that of the bottom of the effluent area.

The present disclosure further provides an air conditioner, which includes an indoor unit. The indoor unit includes a chassis, a washing module, and a water blocking structure. The chassis includes a condensate area and an effluent area adjacent to the condensate area and above the condensate area. A portion of a bottom of the effluent area adjacent to the condensate area defines a water outlet hole. The washing module is mounted on the chassis and has a discharge pipe extending into the effluent area. The water blocking structure is arranged between the condensate area and the effluent area.

In the technical solution of the present disclosure, the water blocking structure is arranged between the condensate area and the effluent area; one end of the water blocking structure is connected to the washing module, and the other end of the water blocking structure is in front of the water outlet hole to shield a part of the water outlet hole. When the washing module works, the effluent in the effluent area which is above the condensate area is blocked by the water blocking structure, and guided to the water outlet hole. As such effluent would not flow into the condensate area, which is below the effluent area, thereby effectively preventing the effluent from polluting the clean condensate water in the condensate area, further improving the cleaning effect of filter screen. Therefore, it is conducive to reducing health problems associated with the use of air conditioner.

BRIEF DESCRIPTION OF THE DRAWINGS

In order to more clearly illustrate the embodiments of the present disclosure or the technical solutions in the related art, the drawings referenced in the embodiments or the related art will be briefly described below. Obviously, the drawings in the following description are exemplary embodiments of the present disclosure, and other drawings may be obtained according to the structures shown in the drawings without any creative work for those skilled in the art.

Figure 1:
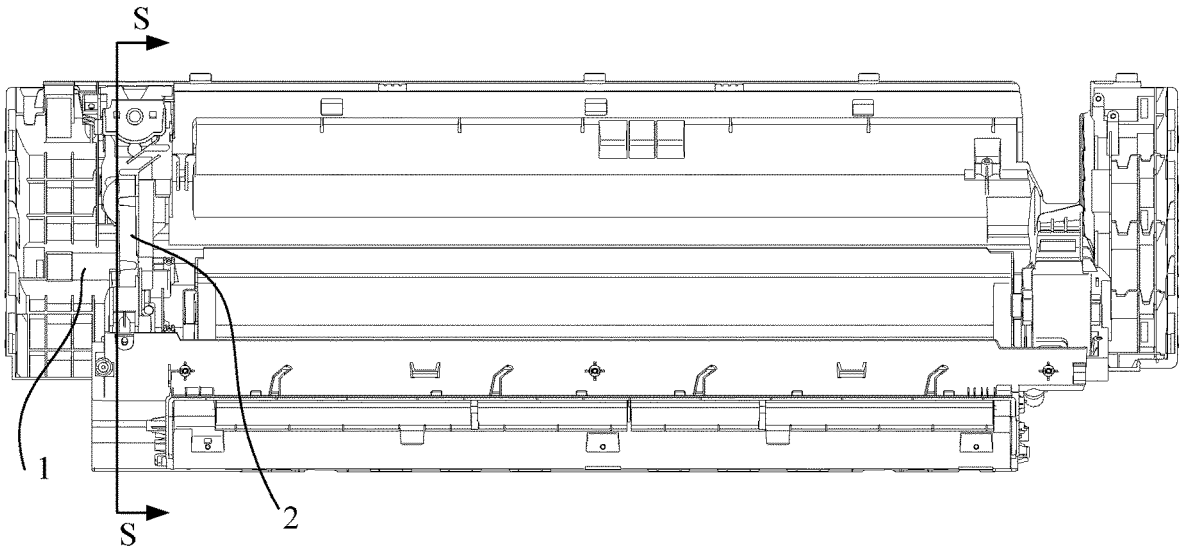
FIG. 1 is a front elevational view of an indoor unit according to an embodiment of the present disclosure, in which a chassis is mounted with a washing module.

The implementation, functional features and advantages of the present disclosure will be further described with reference to the accompanying drawings.

DETAILED DESCRIPTION OF THE EMBODIMENTS

As following, the technical solution in the embodiments of the present disclosure will be described clearly and completely with reference to the drawings in the embodiment of the present disclosure. Obviously, the described embodiment is only a part of the embodiment of the present disclosure, not all of the embodiments. Based on the embodiments in the present disclosure, all other embodiments perceived by those ordinary skills in the art without creative effort should be fallen within the protection scope of the present disclosure.

It should be noted that if directional indications (such as up, down, left, right, front, back, etc.) are involved in the embodiments of the present disclosure, the directional indications are only used to explain the relative positional relationship and movement between the components in a certain posture (as shown in the drawings), and if the specific posture changes, the directional indications will change accordingly.

In addition, if there are descriptions of "first" and "second" in the embodiments of this disclosure, the descriptions of "first" and "second" are used for descriptive purposes only and cannot be understood as indicating or implying their relative importance or implicitly indicating the number of indicated technical features. Thus, features defining "first" and "second" may explicitly or implicitly include at least one such feature. In addition, aspects of the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present disclosure.

The present disclosure provides an indoor unit of an air conditioner.

Figure 2:
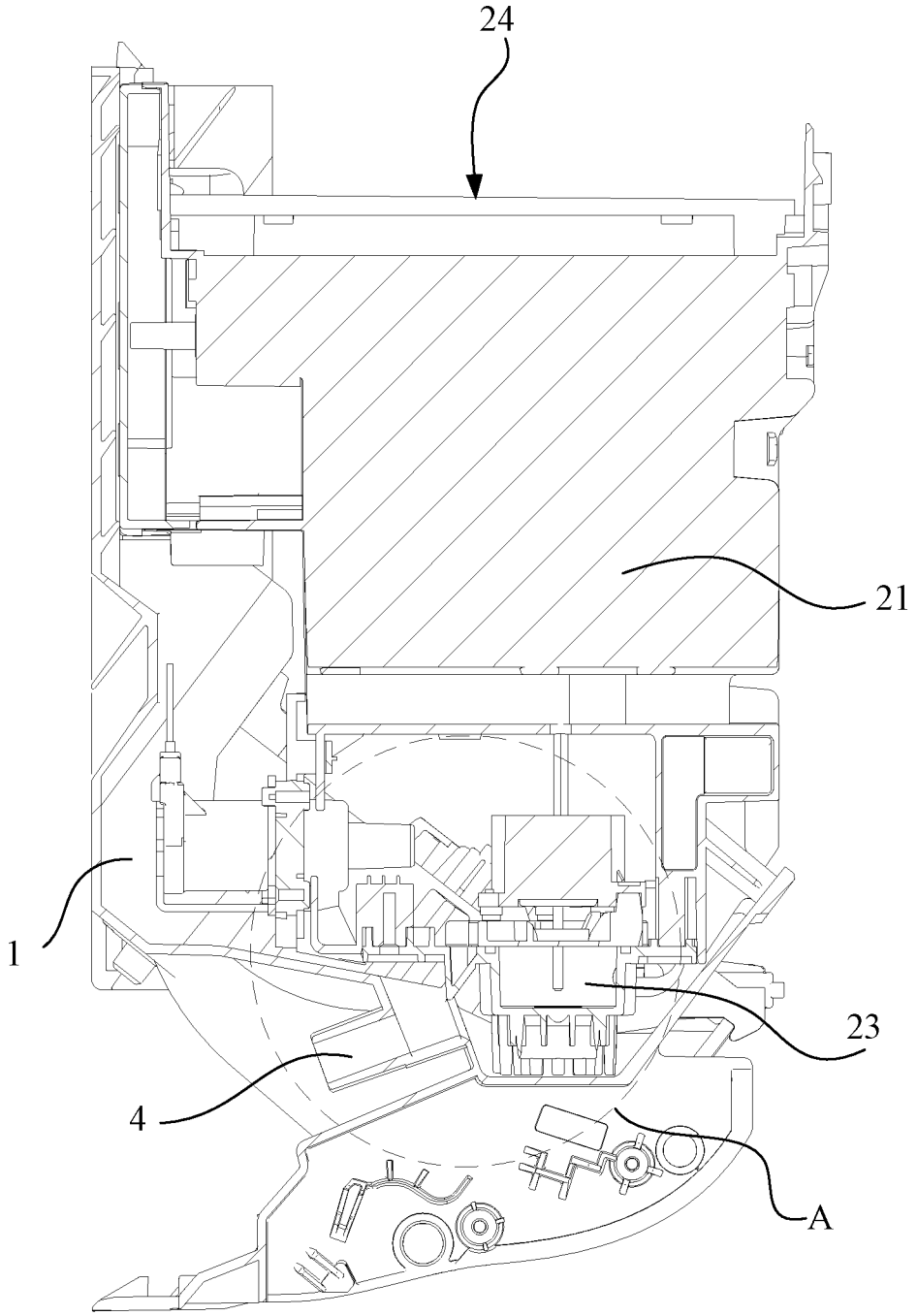
FIG. 2 is a cross sectional view along S-S line as shown in FIG. 1.
Figure 6:
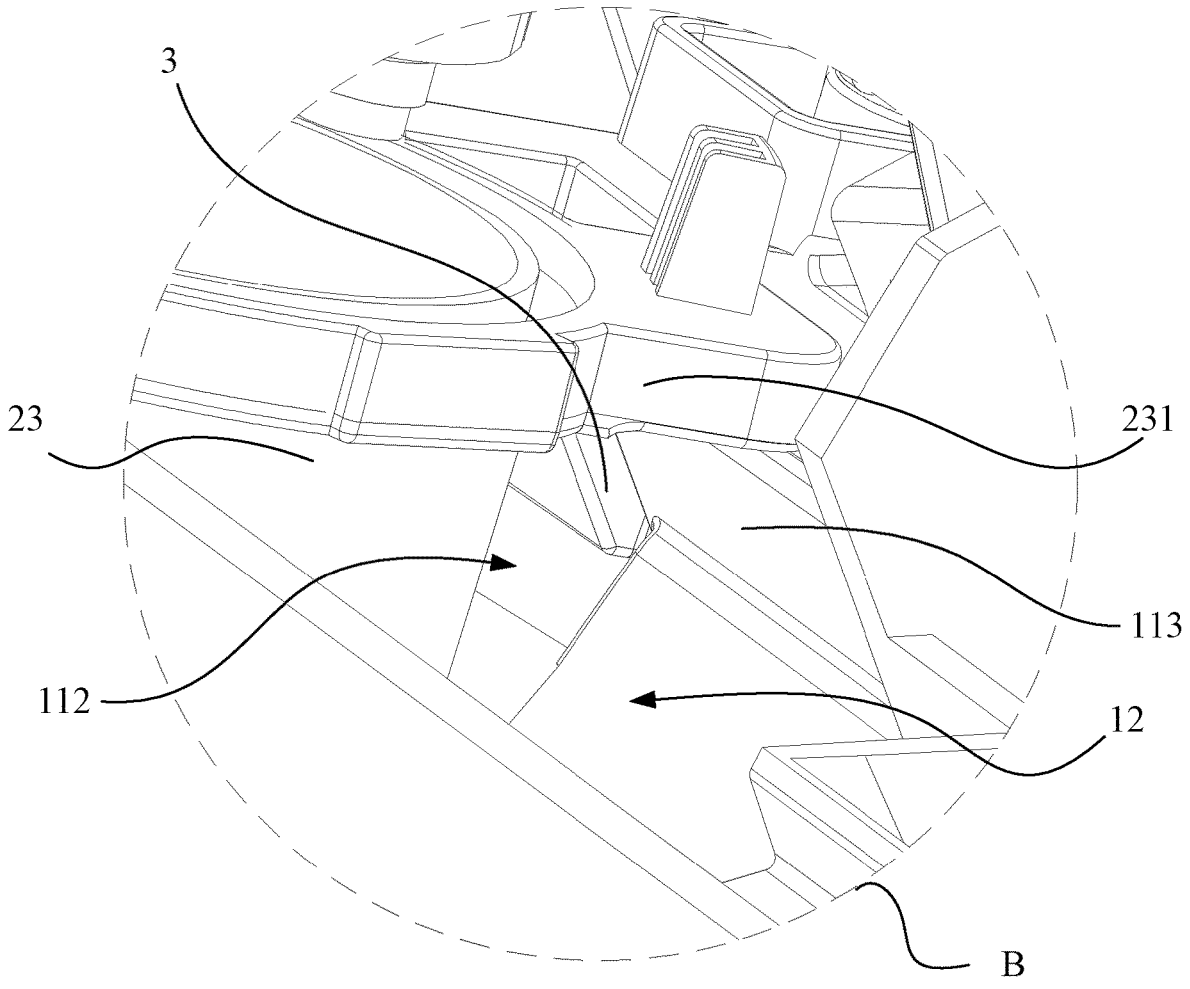
FIG. 6 is an enlarged view of portion B as shown in FIG. 5.
Figure 9:
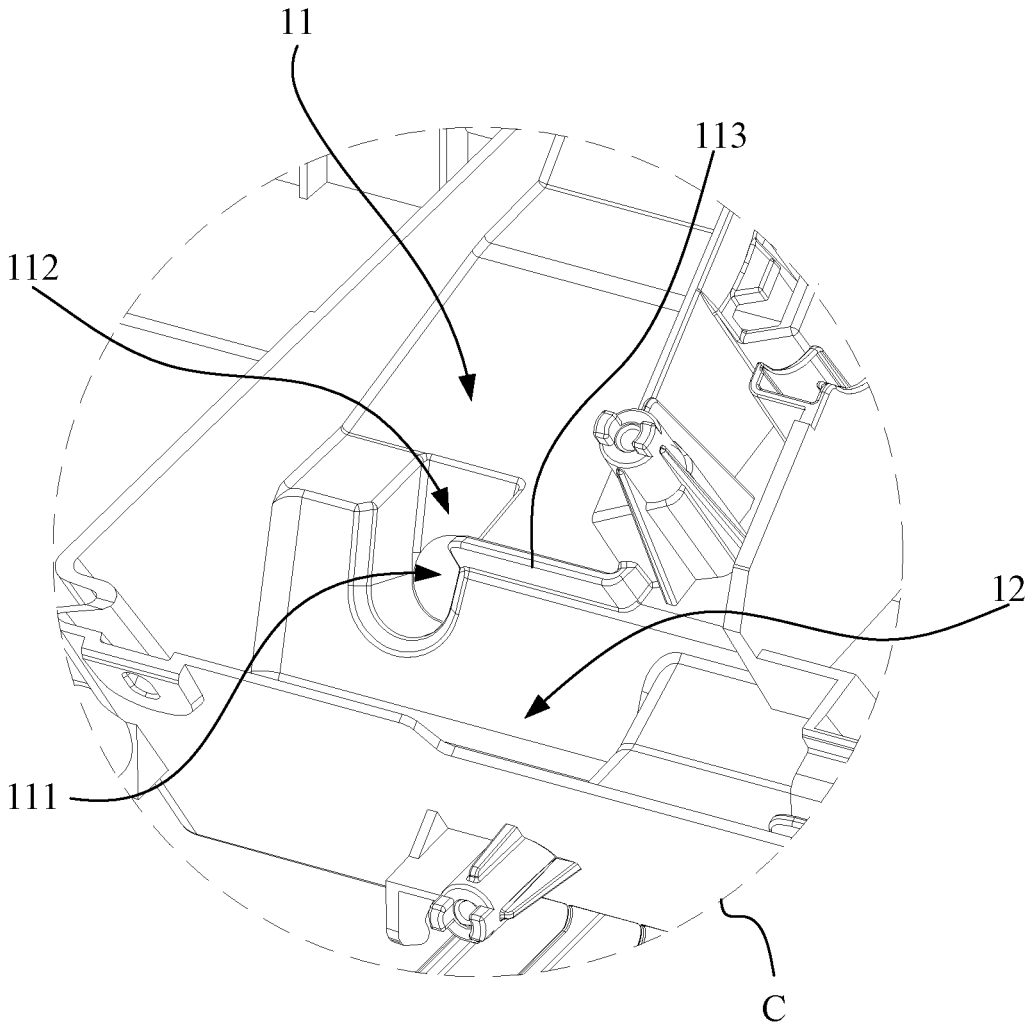
FIG. 9 is an enlarged view of portion C as shown in FIG. 8.

Referring to FIGS. 2, 6 and 9, in one embodiment of the present disclosure, the indoor unit includes a chassis 1, a washing module 2, and a water blocking structure 3. The chassis 1 includes an effluent area 11 and a condensate area 12. The effluent area 11 is adjacent to the condensate area 12 and positioned above or higher than the condensate area 12. A portion of a bottom of the effluent area 11 adjacent to the condensate area 12 defines a water outlet hole 111. The washing module 2 is mounted on the chassis 1 and has a water box 21, a discharge pipe 22 communicated with the water box 21, and a water pump 23 arranged at a lower end of the water box 21. The water pump 23 extends into the condensate area 12 and is configured to pump condensate water into the water box 21. The discharge pipe 22 extends into the effluent area 11. The effluent in the water box 21 can be guided into the effluent area 11, and then drained out through the water outlet hole 111. The water blocking structure 3 is arranged between the condensate area 12 and the effluent area 11.

It needs to be noted that, in the embodiment, the indoor unit of the air conditioner is referred to as an indoor unit of a fresh air type wall-mounted air conditioner. Of course, the technical solution of the present disclosure can also be applied to other types of indoor units which are provided with a filter screen. The indoor unit of the present disclosure not only includes some common main components, such as housing, heat exchanger (not shown) received in the housing, wind turbine (not shown), and filter screen (not shown), but also includes fresh air device (not shown). In one embodiment, the fresh air device is usually located in one end of the housing, and an air inlet cavity is defined in the fresh air device and communicated to the outdoor environment by a fresh air inlet pipe. The filter screen is set in a grille assembly (not shown) at the top of the housing and is connected to the washing module 2. The grille assembly includes a first grille and a second grille that are partially overlapped with and detachably connected to the first grille. A first cavity is defined between the first grille and the second grille, and a second cavity is defined between the second grille and an inlet air barrier.

Figure 4:
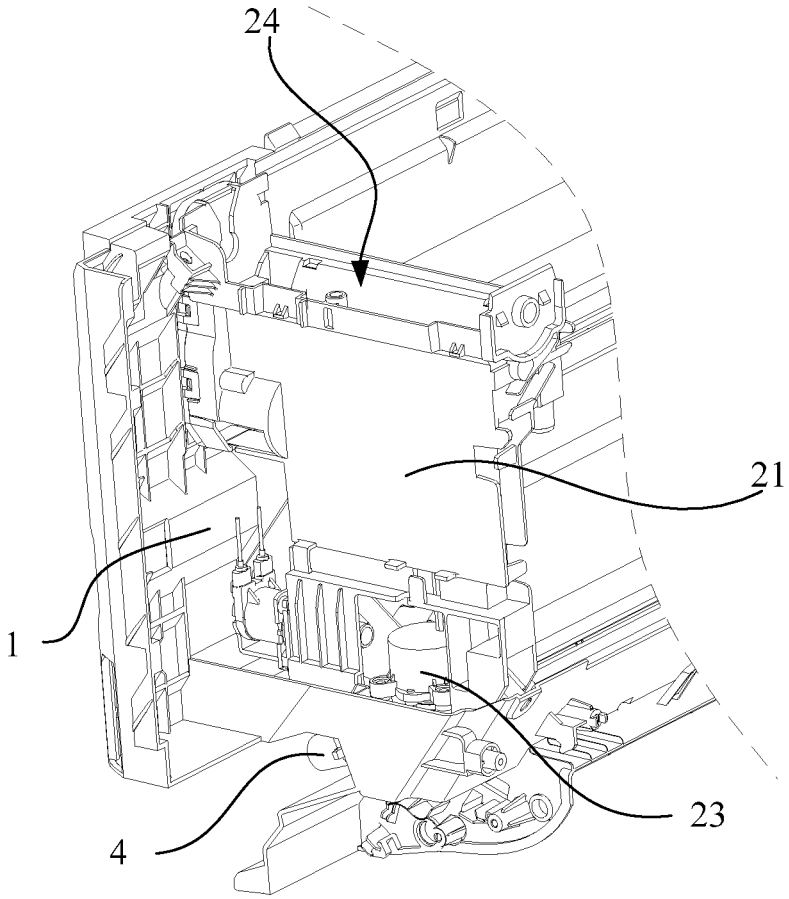
FIG. 4 is a structure view of the chassis and the washing module in FIG. 1, shown from a first view.
Figure 5:
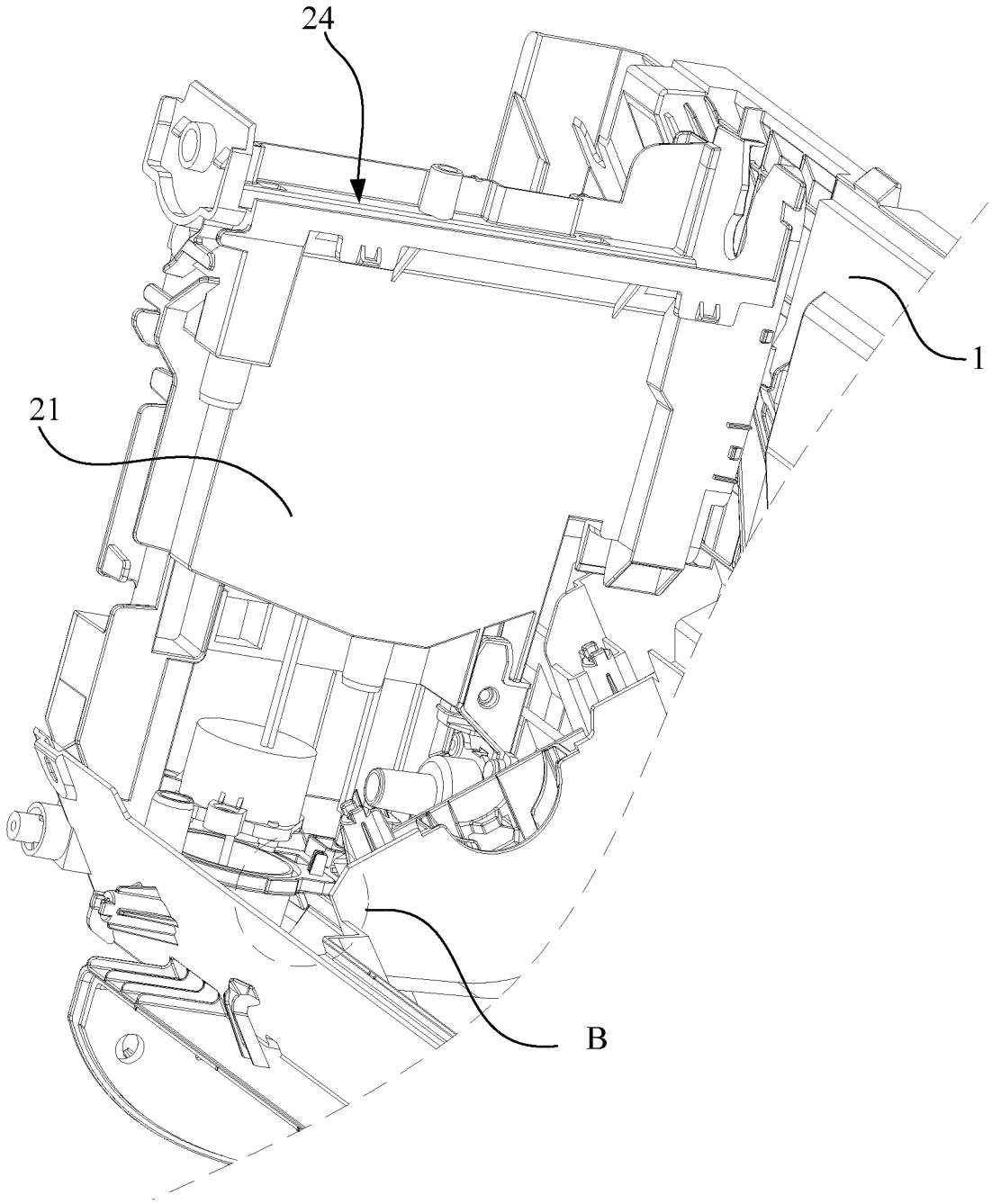
FIG. 5 is a structure view of the chassis and the washing module in FIG. 1, shown from a second view.

Here, the washing module 2 normally includes a rotating shaft (not shown), a brush component (not shown), and a drive device (not shown). The drive device is configured to drive related parts to rotate to enable the soft filter screen to wrap around on the rotating shaft, and the brush component adjacent to the filter screen can contact the filter screen wrapped around on the rotating shaft and clean the filter screen. Meanwhile, the filter screen is rotated with the rotating shaft, one end of the filter screen is entered into the second cavity, and gradually expanded and received in the second cavity along the direction away from the rotating shaft. Of course, when the rotating shaft is rotated in the opposite direction, the filter screen can be gradually wrapped around on the rotating shaft from the second cavity, then can be gradually expanded in the first cavity to complete the cleaning of the filter screen again. These cleaning processes are automatically completed under the control of the air conditioner, which avoids dismounting and cleaning the filter screen manually, so the cleaning process of the filter screen is very convenient. In addition, as shown in FIG. 4 and FIG. 5, the washing module 2 also includes a water tank 24 at the upper end of water box 21, and the brush component is at least partially located in the water tank 24. When the washing module 2 works, the water pump 23 at the lower end of the water box 21 pumps the condensate water in the condensate area 12 to the water box 21, for filling the water tank 24 with clean condensate water. The hairs of the brush of the brush component is contacted with filter screen, for cleaning the filter screen from top to bottom, then the dirtied hairs can be cleaned in the water tank 24. Then the effluent can be guided to the effluent area 11 through the discharge pipe 22 below the effluent area 11, and discharged out through an outlet pipe 4 communicated with the effluent area 11. However, in common washing module 2, the condensate area 12 containing the condensate water is also communicated with the outlet pipe 4, and the condensate area 12 is normally arranged near to the effluent area 11, the effluent from the effluent area 11 is prone to flow into the condensate area 12, resulting in a contamination of condensed water, and further reducing the clean effect of the filter screen.

In the present embodiment, the water blocking structure 3 is arranged between the condensate area 12 and the effluent area 11; one end of the water blocking structure 3 is connected to the washing module 2, and the other end of the water blocking structure 3 is in front of the water outlet hole 111 to shield a part of the water outlet hole 111. When the washing module 2 works, the effluent in the effluent area 11 which is above the condensate area 12 is blocked by the water blocking structure 3, and guided to the water outlet hole 111. As such effluent would not flow into the condensate area 12 which is below the effluent area 11, thereby effectively preventing the effluent from polluting the clean condensate water in the condensate area 12, further improving the cleaning effect of filter screen. Therefore, it is conducive to reducing health problems associated with the use of air conditioner.

Figure 3:
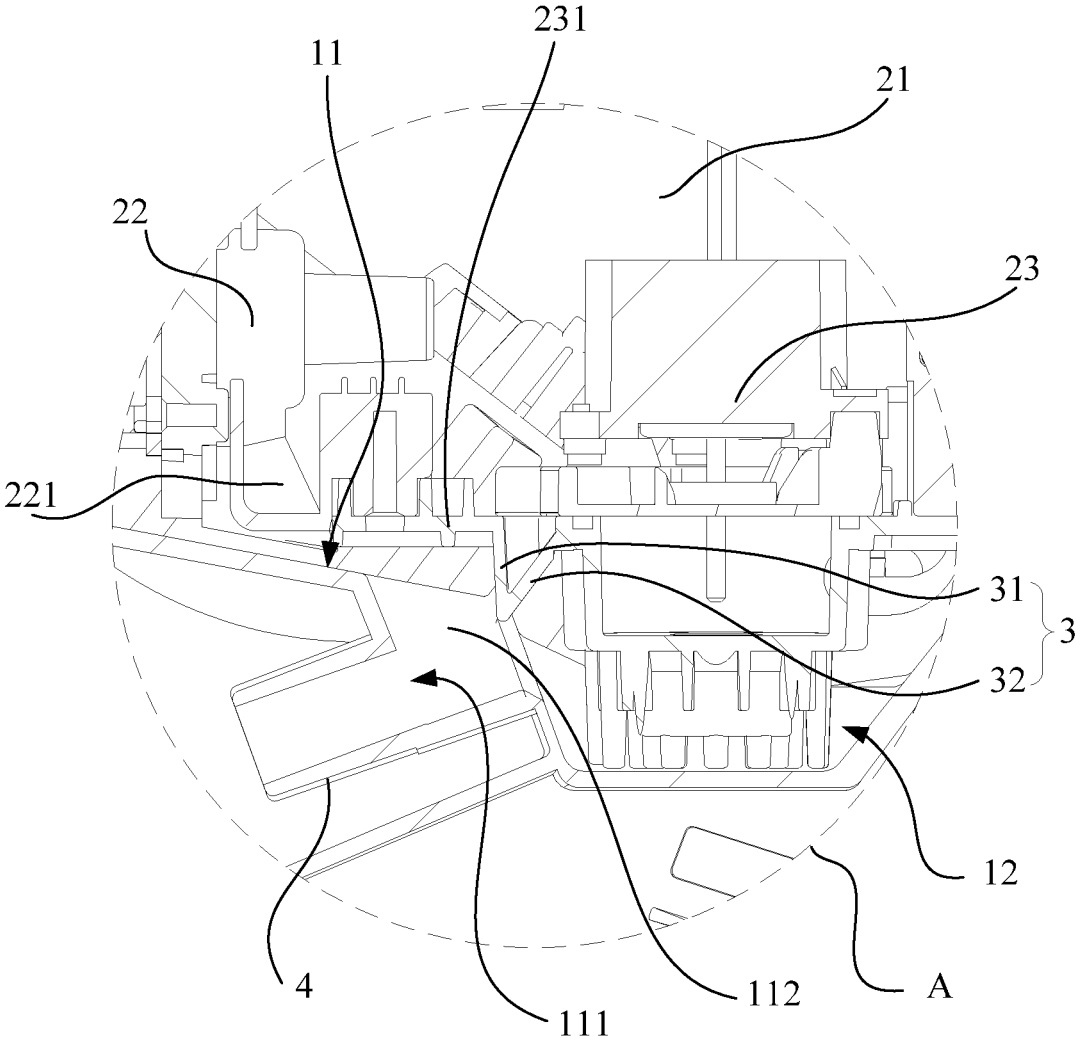
FIG. 3 is an enlarged view of portion A as shown in FIG. 2.

Referring to FIGS. 3 and 9, in the present embodiment, the bottom of the effluent area 11 is inclined downwardly to the condensate area 12. Of course, in another embodiments, the bottom of the effluent area 11 is not configured to incline. While, in the present embodiment, the inclined bottom of the effluent area 11 is beneficial to drain the effluent in the discharge pipe 22 out, so the effluent is not prone to accumulate in the effluent area 11. Therefore, it is beneficial to improve the cleanliness of air conditioner.

Specifically, in the present embodiment, the bottom of the effluent area 11 defines an avoiding groove 112, a side of the avoiding groove 112 facing the condensate area 12 defines a notch communicated with the condensate area 12, a side wall of the avoiding groove 112 opposite to the condensate area 12 defines a water outlet hole 111 communicated with the outlet pipe 4 of the indoor unit. As such, the arrangement of the avoiding groove 112 can give an enough space for conveniently arranging the water blocking structure 3 and preventing sewage from blocking the water outlet hole 111 at a certain degree. Here, as shown in FIGS. 2 to 4, the outlet pipe 4 is normally inclined backwardly and downwardly, for discharging the effluent and the overflowed condensate water rapidly. Meanwhile, the setting of the avoiding groove 112 can give enough space to facilitate the setting of the water blocking structure 3, and further has a certain degree to prevent sewage in the pollution blocking water outlet hole 111. In addition, in one embodiment, as shown in FIGS. 3, 5 and 6, the water blocking structure 3 extends into the avoiding groove 112, the upper end of the water blocking structure 3 is connected to the wash module 2, the lower end of the water blocking structure 3 is located in front of the water outlet hole 111 to partially obscure the water outlet hole 111, and the lower edge of the water blocking structure 3 is positioned lower than a portion of the bottom of the effluent area 11 extending downwardly to the water blocking structure 3 and being in contact with the water blocking structure 3, for further blocking the effluent from flowing downwardly.

Figure 7:
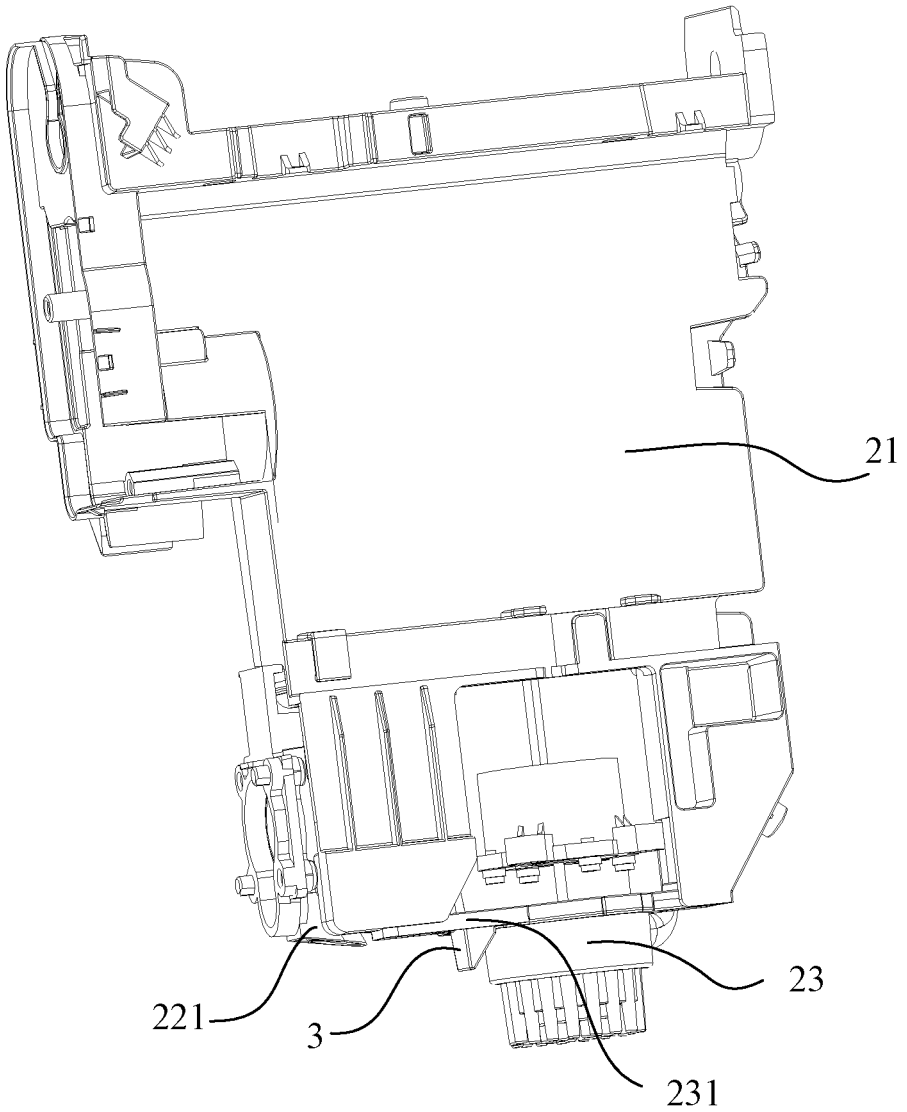
FIG. 7 is a structure view of the washing module as shown in FIG. 5.

Referring to FIGS. 3 and 7, in the present embodiment, the water pump 23 includes a protruding edge 231 protruding outwardly from an upper edge of the water pump 23 and detachably connected to the lower end of the water box 21. Specifically, the protruding edge 231 is detachably connected with the water box 21 through a screw, etc., and the water box 21 can be taken out easily for subsequent repair and replacement. The water blocking structure 3 includes a water baffle 31 extending downwardly from the protruding edge 231, and a support board 32 extending upwardly from a lower edge of the water baffle 31 and connected to the protruding edge 231. Referring to FIG. 3, the cross section of the water blocking structure 3 is a downward triangle. In addition, the water blocking structure 3 specifically includes the water baffle 31 and the support board 32, the water baffle 31 extending downwardly from the protruding edge 231, the support board 32 extending from the lower edge of the water baffle 31 forwardly and upwardly to be connected with the protruding edge 231, that is, as shown in FIG. 3, the water blocking structure 3 is cross-sectional for the downward triangular setting. However, the design of the water blocking structure 3 is not limited to this. In another embodiment, the water blocking structure 3 can only include the water baffle 31. In the present embodiment, the support board 32 is configured to support the water baffle 31 for improving the entire strength of the water blocking structure 3. As such, the water baffle 31 is not prone to bend or break for maintaining a good water blocking effect.

Referring to FIGS. 3 and 7, in the present embodiment, the water blocking structure 3 is integrally arranged with the water pump 23. So that, the water blocking structure 3 and the housing of the water pump 23 can be manufactured together through the injection process, and do not need to be manufactured and assembled. In this case, the connecting strength between the water blocking structure 3 and the water pump 23 is further enhanced. Of course, in other embodiments, the water blocking structure 3 and the water pump 23 are individual members, and the water blocking structure 3 is detachably connected to the water pump 23.

Figure 8:
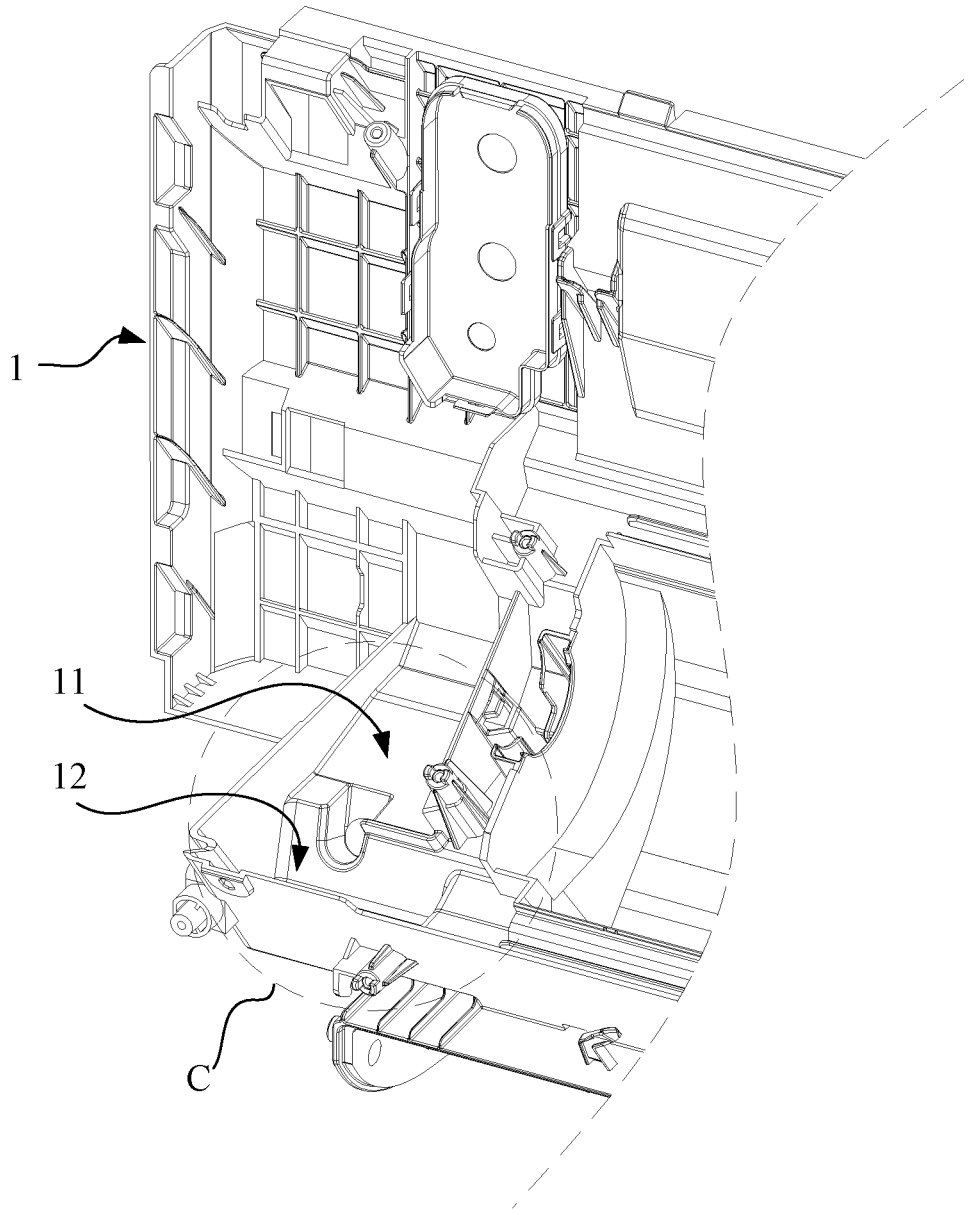
FIG. 8 is a structure view of a part of the chassis as shown in FIG. 1.

Referring to FIGS. 6 and 8-9, in the present embodiment, a water blocking flange 113 protrudes forwardly and upwardly from a lower edge of the effluent area 11. Understandably, the effluent area 11 is positioned above or higher than the condensate area 12, so the water blocking flange 113 can effectively prevent effluent from entering the condensate area 12. And the water blocking flange 113 is cooperated with the water blocking structure 3 to guide the effluent in the effluent area 11 to flow into the avoiding groove 112, then the effluent would flow into the outlet pipe 4 through the water outlet hole 111. In one embodiment, the water blocking flange 113 is abutted against the water blocking structure 3, so that there is no gap where the water blocking flange 113 and the water blocking structure 3 come into contact, thus further preventing effluent from entering the condensate area 12. In addition, in one embodiment, the avoiding groove 112 and the water outlet hole 111 are both defined in a side of the effluent area 11 away from the heat exchanger of the indoor unit, for avoid the splashing effluent from damaging the heat exchanger and other components as much as possible.

In addition, referring to FIGS. 3 and 7, in the present embodiment, the discharge pipe 22 includes a discharge end 221 facing the effluent area 11. The discharge end 221 is gradually expanded in a downward direction for discharging the effluent carrying dusts smoothly. A lower end surface of the discharge end 221 is inclined downwardly to the condensate area 12, and a gap is defined between the lower end surface of the discharge end 221 and the bottom of the effluent area 11. In one embodiment, an inclination angle of the lower end surface of the discharge end 221 is consistent with that of the bottom of the effluent area 11, for preventing the effluent, discharged from an opening of the discharge end 221, from being splashed. As such the effluent could not splash into the condensate area 12.

The present disclosure also provides an air conditioner which includes an indoor unit. The specific structure of the indoor unit can be referred to the above embodiments. Since the air conditioner takes all the technical solutions of the aforementioned embodiments, it has at least all the beneficial effects brought by the technical solutions of these embodiments, which will thus not be described in detail herein.

The above description refers to only optional embodiments of the present disclosure, and thus does not limit the scope of the present disclosure, and any transformation of equivalent structure made under the inventive concept of the present disclosure by using the contents of this specification and attached drawings, or direct/indirect application in other relevant technical fields, shall be included in the scope of the present disclosure.

What is claimed is:

1. An indoor unit of an air conditioner, comprising:
a chassis comprising:
a condensate area; and
an effluent area adjacent to the condensate area and positioned above the condensate area, wherein a portion of a bottom of the effluent area adjacent to the condensate area defines a water outlet hole;
a washing module mounted on the chassis and comprising:
a discharge pipe extending into the effluent area;
a water box; and
a water pump mounted to a lower end of the water box; and
a water blocking structure arranged between the condensate area and the effluent area, the water blocking structure comprising a water baffle that is configured to inhibit liquid communication from the effluent area to the condensate area,
wherein the bottom of the effluent area is inclined downwardly to the condensate area, and
wherein the water pump further comprises a protruding edge protruding outwardly from an upper edge of the water pump and detachably connected to the lower end of the water box, wherein the water blocking structure is arranged on the protruding edge.

2. The indoor unit according to claim 1, further comprising:
an outlet pipe communicated with the water outlet hole,
wherein the bottom of the effluent area defines an avoiding groove, and a side of the avoiding groove opposite to the condensate area defines the water outlet hole, and
wherein the water blocking structure extends into the avoiding groove; a top end of the water blocking structure is connected to the washing module; and a lower end of the water blocking structure is in front of the water outlet hole and configured to shield a part of the water outlet hole.

3. The indoor unit according to claim 1, wherein a lower edge of the water blocking structure is positioned lower than the portion of the bottom of the effluent area, wherein said portion extends downwardly to the water blocking structure and is in contact with the water blocking structure.

4. The indoor unit according to claim 1, wherein:
the water baffle extends downwardly from the protruding edge; and
the water blocking structure further comprises a support board extending forwardly and upwardly from a lower edge of the water baffle and connected to the protruding edge.

5. The indoor unit according to claim 1, wherein the water blocking structure is integrally arranged with the water pump.

6. The indoor unit according to claim 1, further comprising:
a water blocking flange protruding forwardly and upwardly from a lower edge of the effluent area.

7. The indoor unit according to claim 6, wherein the water blocking flange is abutted against the water blocking structure.

8. The indoor unit according to claim 1, wherein the discharge pipe comprises:
a discharge end facing the effluent area, with an opening of the discharge end flared downwardly.

9. An air conditioner comprising:
an indoor unit comprising:
a chassis comprising:
a condensate area; and
an effluent area adjacent to the condensate area and positioned above the condensate area, wherein a portion of a bottom of the effluent area adjacent to the condensate area defines a water outlet hole;
a washing module mounted on the chassis and comprising:
a discharge pipe extending into the effluent area;
a water box; and
a water pump mounted to a lower end of the water box; and
a water blocking structure arranged between the condensate area and the effluent area, the water blocking structure comprising a water baffle that is configured to inhibit liquid communication from the effluent area to the condensate area,
wherein the bottom of the effluent area is inclined downwardly to the condensate area, and
wherein the water pump further comprises a protruding edge protruding outwardly from an upper edge of the water pump and detachably connected to the lower end of the water box, wherein the water blocking structure is arranged on the protruding edge.

10. The air conditioner according to claim 9, further comprising:
an outlet pipe communicated with the water outlet hole,
wherein the bottom of the effluent area defines an avoiding groove, and a side of the avoiding groove opposite to the condensate area defines the water outlet hole, and wherein the water blocking structure extends into the avoiding groove; a top end of the water blocking structure is connected to the washing module; and a lower end of the water blocking structure is in front of the water outlet hole and configured to shield a part of the water outlet hole.

11. The air conditioner according to claim 9, wherein a lower edge of the water blocking structure is positioned lower than the portion of the bottom of the effluent area, wherein said portion extends downwardly to the water blocking structure and is in contact with the water blocking structure.

12. The air conditioner according to claim 9, wherein:

the water baffle extends downwardly from the protruding edge; and the water blocking structure further comprises a support board extending forwardly and upwardly from a lower edge of the water baffle and connected to the protruding edge.

13. The air conditioner according to claim 9, wherein the water blocking structure is integrally arranged with the water pump.

14. The air conditioner according to claim 9, further comprising:

a water blocking flange protruding forwardly and upwardly from a lower edge of the effluent area, and abutted against the water blocking structure.

* * * * *